US007849662B2

(12) United States Patent
Rapp et al.

(10) Patent No.: US 7,849,662 B2
(45) Date of Patent: Dec. 14, 2010

(54) BLISTER PACKAGE AND METHOD FOR PACKING A BLISTER IN THE BLISTER PACKAGE

(75) Inventors: Reinhard Rapp, Stuttgart (DE); Helmut Deichert, Waiblingen (DE)

(73) Assignee: Robert Bosch GmbH, Stuttgart (DE)

( * ) Notice: Subject to any disclaimer, the term of this patent is extended or adjusted under 35 U.S.C. 154(b) by 176 days.

(21) Appl. No.: 11/814,445

(22) PCT Filed: Oct. 26, 2006

(86) PCT No.: PCT/EP2006/067831

§ 371 (c)(1),
(2), (4) Date: Jul. 20, 2007

(87) PCT Pub. No.: WO2007/057286

PCT Pub. Date: May 24, 2007

(65) Prior Publication Data

US 2010/0038277 A1 Feb. 18, 2010

(30) Foreign Application Priority Data

Nov. 21, 2005 (DE) ..... 10 2005 055 357
May 10, 2006 (DE) ..... 10 2006 021 980

(51) Int. Cl.
*B65B 47/00* (2006.01)

(52) U.S. Cl. ..... 53/453; 53/484; 206/528; 206/531; 206/532

(58) Field of Classification Search ..... 206/528, 206/531, 532, 534, 538, 469, 232, 472, 473; 53/453, 484, 491
See application file for complete search history.

(56) References Cited

U.S. PATENT DOCUMENTS

| | | | | |
|---|---|---|---|---|
| 3,912,082 | A * | 10/1975 | Gerner et al. | 206/531 |
| 3,924,747 | A * | 12/1975 | Gerner | 206/531 |
| 5,542,235 | A | 8/1996 | Konstandin | |
| 5,954,202 | A * | 9/1999 | Mellon | 206/462 |
| 6,024,222 | A | 2/2000 | Friberg et al. | |
| 6,219,997 | B1 | 4/2001 | Friberg et al. | |
| 6,951,282 | B2 * | 10/2005 | Jones | 206/469 |
| 2004/0035740 | A1 * | 2/2004 | Paliotta et al. | 206/531 |
| 2004/0050748 | A1 | 3/2004 | Ehrlund | |
| 2005/0035023 | A1 * | 2/2005 | Breu et al. | 206/531 |
| 2005/0274643 | A1 * | 12/2005 | Arnold | 206/531 |
| 2007/0056876 | A1 * | 3/2007 | Jones | 206/531 |

(Continued)

FOREIGN PATENT DOCUMENTS

| | | |
|---|---|---|
| CA | 2 352 428 | 6/2000 |

(Continued)

*Primary Examiner*—David T Fidei
(74) *Attorney, Agent, or Firm*—Michael J. Striker

(57) ABSTRACT

A blister pack and a method for packaging a blister in the blister pack are proposed. The blister pack 10 in this case comprises a base field 14 with at least one recess 16 or perforation 18 for removal of at least one product arranged in a blister 36. A bottom field 26 is connected to the base field 14. A closure field 30 is connected to the bottom field 26. The blister pack 10 is distinguished by a fixing tab 22 which is mounted on the base field 14 for the purpose of fixing at least one blister 36 that is to be packaged in the blister pack 10.

4 Claims, 6 Drawing Sheets

U.S. PATENT DOCUMENTS

| | | | | |
|---|---|---|---|---|
| 2007/0163918 | A1* | 7/2007 | Klatt et al. | 206/531 |
| 2007/0272586 | A1* | 11/2007 | Hession | 206/532 |
| 2008/0142400 | A1* | 6/2008 | Arnold | 206/531 |

FOREIGN PATENT DOCUMENTS

| | | |
|---|---|---|
| DE | 1 870 772 | 4/1963 |
| DE | 2 107 692 | 8/1972 |
| DE | 33 41 573 | 9/1984 |
| DE | 43 06 996 | 9/1994 |
| DE | 198 55 318 | 4/2000 |
| DE | 697 19 823 | 2/2004 |
| EP | 0 393 942 | 10/1990 |
| EP | 1 215 127 | 6/2002 |
| FR | 1426392 | 1/1966 |
| GB | 2 256 853 | 12/1992 |
| JP | 2003226379 | 8/2003 |
| JP | 2003237836 | 8/2003 |
| WO | 01/00135 | 1/2001 |

* cited by examiner

BLISTER PACKAGE AND METHOD FOR PACKING A BLISTER IN THE BLISTER PACKAGE

CROSS-REFERENCE TO RELATED APPLICATIONS

The invention described and claimed hereinbelow is also described in German Patent Applications DE 10 2005 055 357.5 filed on Nov. 21, 2005 and DE 10 2006 021 980.5 filed on May 10, 2006. These German Patent Applications, whose subject matter is incorporated here by reference, provide the basis for a claim of priority of invention under 35 U.S.C. 119(*a*)-(*d*).

BACKGROUND OF THE INVENTION

The present invention relates to a blister package and a method for packaging a blister in the blister package.

DE 198 55 318 C1 has disclosed a packing means for medications in the form of a folding box combination for at least two different primary packaging types—on the one hand containing transdermal bandages and on the other hand containing capsules—in the form of a folding cardboard box that contains all of these capsules and has an adequate space to accommodate individual rectangular bandages that can be loosely inserted separately from one another.

DE 697 19 823 T2 has disclosed a blister package that has an arrangement of cups with two cup sections, each with a set of cups. The cups of one cup section are offset in relation to the cups of the other cup section so that the cups of the two cup sections fit between one another after the folding. A protective unit includes two closing regions, preferably with an intermediate region that is bounded by two fold lines; the protective unit can be folded along the fold lines. A support unit is attached to the cup arrangement so that the cups of at least one cup section are aligned with the at least one hole.

As a rule, packages of this kind are manufactured on specialized machines that manufacture the folded packages from a flat, generally one-layer blank by means of folding. The blister and the patient information optionally to be inserted are glued or sealed in place in an intermediate step of the folding process.

As a rule, machines of this kind are only for use in manufacturing these foldable blister packages.

The object of the present invention is to provide a blister package that can be filled with at least one blister by a conventional horizontal cartoning machine; only slight modifications of the horizontal cartoning machine are required. This object is attained by the defining characteristics of the independent claims.

DISCLOSURE OF THE INVENTION

The blister package according to the defining characteristics of claim 1 has the advantage over the prior art that it has essentially the same construction as a conventional folding box, but its anchoring flaps make it suitable for anchoring the at least one blister, which is to be packaged, in the blister package. Due to the shape of the package, which is based closely on that of a folding box, it is now possible to package blisters and optionally also package inserts using an only slightly modified horizontal cartoning machine. Existing horizontal cartoning machines that package conventional blisters in folding boxes can easily be retrofitted for the novel blister package. This novel blister package is also referred to as a wallet package since it can be folded open like a wallet.

The preparation of the wallet package can, as with conventional folding boxes, be executed on a longitudinal seam gluing machine. Specially designed, very expensive wallet machines are now no longer required.

The method according to the invention for packing a blister in the blister package also has the advantage that due to the lateral insertion of the blister into the constructed folding box, the mechanics of the packaging machine are aligned with those of a horizontal cartoning machine. It is therefore possible to do away with an insertion of the blister during the folding process of the blank.

Other suitable modifications ensue from other dependent claims and the description.

An exemplary embodiment of a blister package and a method for packing a blister in the blister package is shown in the drawings and will be described in greater detail below.

DESCRIPTION OF THE PREFERRED EMBODIMENTS

Figure 1:
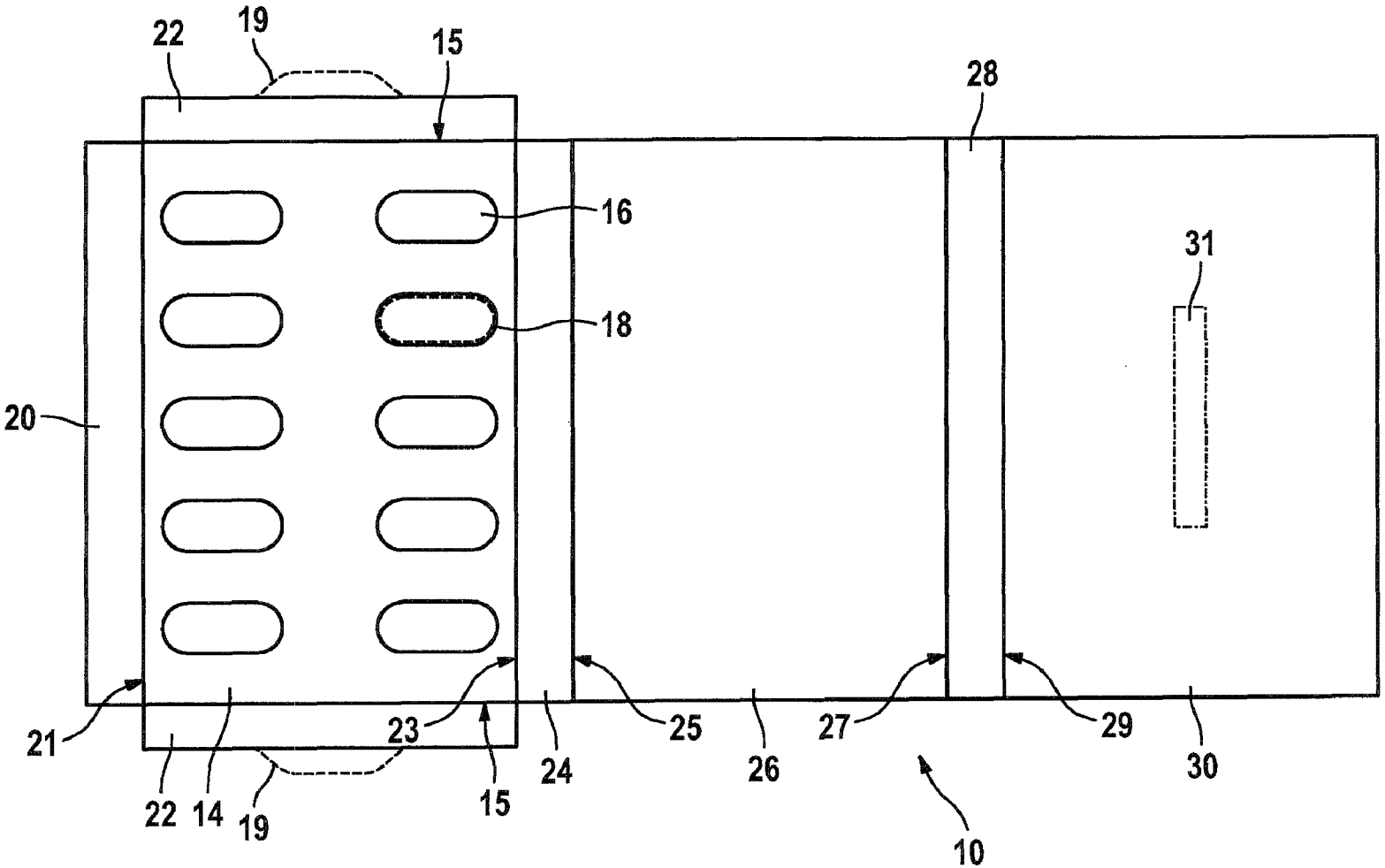
FIG. 1 shows an outer part of the blister package when folded open.

The blister package 10 shown in FIG. 1 is composed of a rectangular base region 14 that contains cutouts 16 or at least one perforation 18 for such a cutout 16 in accordance with the geometry of the blister 36 to be packaged. On the short sides of the rectangular base region 14, there are anchoring flaps 22 that are connected to the base region 14 by means of anchoring flap fold lines 15 and can be folded inward parallel to the base region 14. The geometry of the anchoring flaps 22 here is selected so that when folded inward, they do not cover over the cutouts 16 so as not to prevent the product from being dispensed. Dashed lines serve to depict an optional shape 19 that has a greater width in the middle of the anchoring flap 22 in order to provide more holding area for the blister 36 that is to be anchored. On the one longitudinal side of the base region 14, it is adjoined along a fold line 21 by a stabilizing flap 20 whose width is modeled essentially on the width of a first side wall 24 situated on the other side of the base region 14. The first side wall 24 is connected to the other longitudinal side of the base region 14 by means of a fold line 23 and on the other side, is connected by means of another fold line 25 to a bottom region 26. The area of the bottom region 26 essentially corresponds to the area of the base region 14. By means of a fold line 27, the remaining longitudinal side of the bottom region 26 is adjoined by a second side wall 28, which has essentially the same width as the first side wall 24. By means of a fold line 29, the second side wall 28 is connected to a closing region 30. The closing region 30 has essentially the same area as the base region 14. Optionally, the closing region 30 can have an adhesive 31 applied to it, which in the folded state, attaches the closing region 30 to the base region 14. The adhesive 31, particularly when a hot-setting glue is used, can serve to make the closing region 30 and base region 14 reclosable.

The width of the stabilizing flap does not, however, have to be modeled on that of the side wall 24. Several flaps could also be provided.

Figure 2:
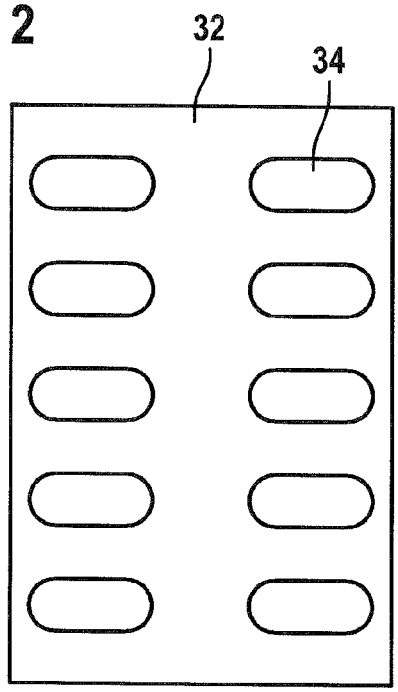
FIG. 2 shows an inner part for the blister package.

FIG. 2 shows a separate inner part 32, which has inner part cutouts 34. The inner part cutouts 34 are embodied so that they can be placed over the cups of the blister 36.

Figure 3:
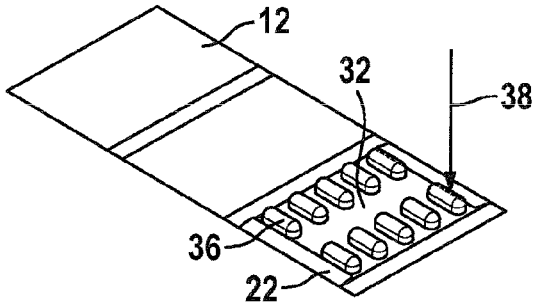
FIG. 3 shows an opened blister package with an inserted blister.

FIG. 3 shows an opened blister package 10; the side of the blister 36 opposite from the cups has been placed onto the base region 14. The inner part 32 has been placed over the cups of the blister 36. The anchoring flaps 22 connected to the base region 14 by means of the anchoring flap fold lines 15 are folded inward and overlap the blister 36, together with the inner part 32 that has been placed over it.

Figure 4:
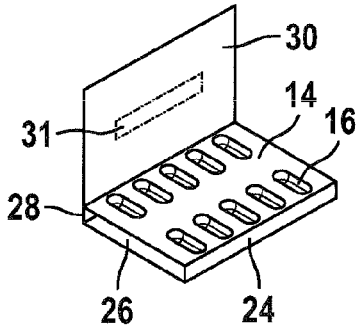
FIG. 4 shows a folded blister package.

FIG. 4 shows a folded blister package 10. In order to close the blister package 10, the closing region 30 and the base region 14 are attached to each other, for example by means of the adhesive 31. Products contained in the blister 36 can now be dispensed by pushing them out of the cups of the blister 36 via the cutouts 16, which are arranged to coincide with the cups of the blister 36. The anchoring flaps 22 secure the blister 36 in this overlapping position either directly or indirectly by means of the inner part 32 that is optionally placed over it.

Figure 5:
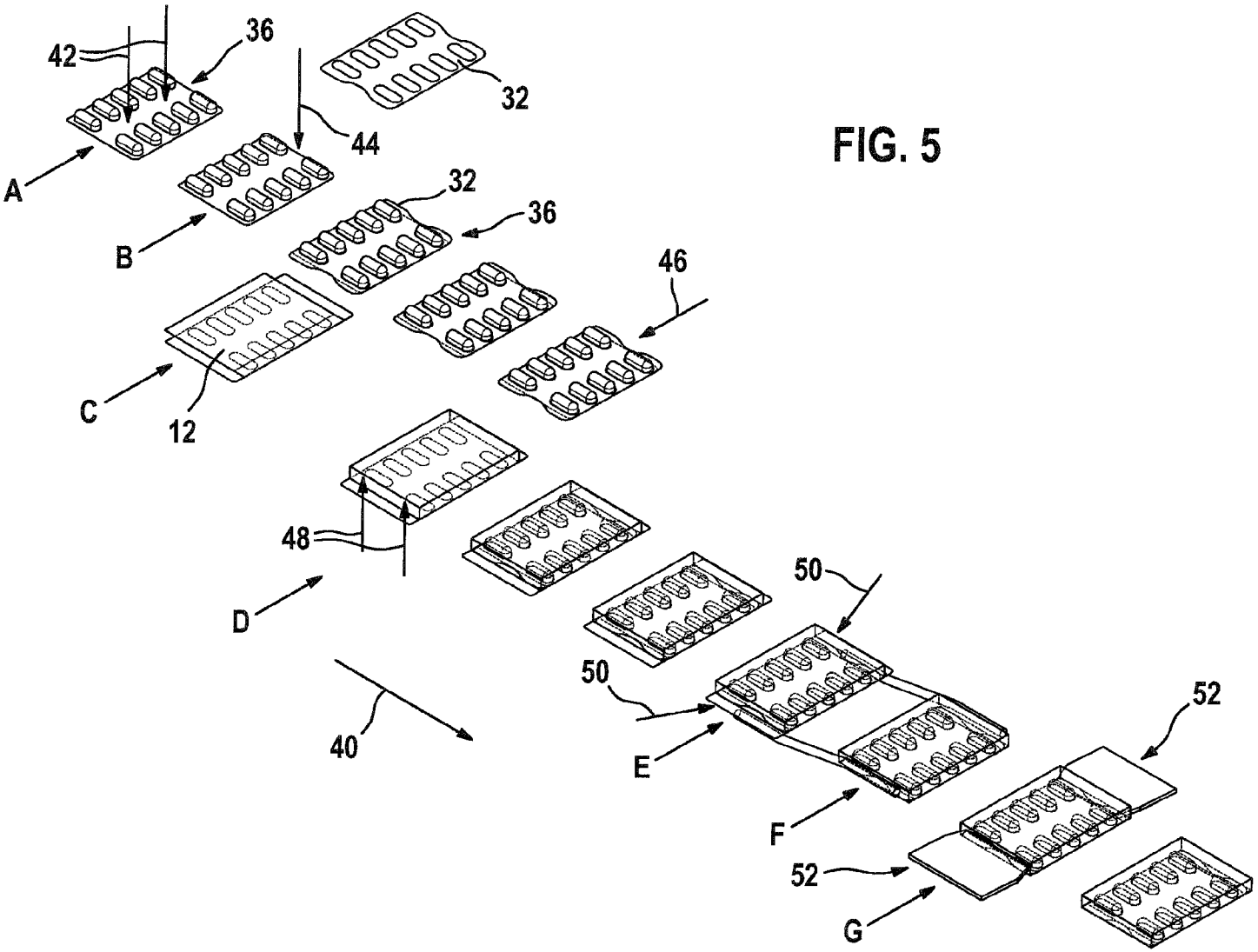
FIG. 5 shows various packing steps for packing the blister into the blister package.

FIG. 5 shows the individual packaging steps for packing the blister 36 in the blister package 10. In an optional step A, an adhesive application 42 is executed on the cup side of the blister 36. This serves in particular to stabilize the blister 36 if an inner part 32—once again only optionally—is to be placed onto the blister 36 so that it overlaps the cups. In this likewise optional step B, the placement of the inner part 32 onto the blister 36 occurs by means of an inner part supply 44. In step C, the blister package 10 is prepared in the form of a folding box 12 and is placed in a storage area. In step D, a folding box-constructing unit 48 constructs the flat folding box 12 so that the blister 36 with the inner part 32 placed onto it can be inserted from the side. An insertion device 46 is provided for this purpose. The blister 36 contained in the folding box 12 is transported further in the travel direction 40. In a step E, an adhesive-applying device 50 applies adhesive onto the folded-open anchoring flaps 22 from above. In a step F, the anchoring flaps are folded inward by an inserting and pressing device 52. In this case, the anchoring flaps 22 are glued to the inner part 32 in order to anchor the blister 36 in place.

The blister package 10 shown in FIG. 1 is embodied in the form of a so-called wallet pack, i.e. the blister package 10 can be folded open as shown in FIG. 3 in order to dispense the blister contents. In the state depicted therein, the blister 36 contents contained in the cups can be dispensed by pushing the blister contents in the penetration direction 38, through the covering foil of the blister 36 and out through the cutouts 16. The cutouts 16 of the base region 14 are situated so that they coincide with all of the back sides of the cups of the blister 36. The blister package 10 can already have cutouts 16 when sold. Alternatively, it would also be possible to merely provide a perforation 18 that the customer pushes through to produce the corresponding cutout 16 when dispensing the blister contents.

In order to anchor the blister 36 in place, the anchoring flaps 22 are folded inward—as shown in FIG. 3—so that they overlap at least the blister 36. For permanent anchoring, it is possible for the anchoring flaps 22 to be permanently glued to the base region 14 and/or the blister 36. In an alternative embodiment in which an inner part 32 is inserted, the anchoring flaps 22 can also be glued to the inner part 32. After the dispensing of the blister contents is complete, the blister package 10 can be reclosed. To that end, the folded open blister package 10 is folded close again so that the bottom region 26 comes into contact with the cups and the closing region 30 comes into contact with the side of the base region 14 oriented away from the blister 36. The bottom region 26, however does not absolutely have to contact the cups. To close the blister package 10, it is possible for an adhesive 31 applied to the closing region 30 or base region 14 to form an adhesive connection with its counterpart. In order to make the blister package 10 reclosable, it is suitable to use a permanently plastic hot-setting glue for the adhesive 31. Alternatively, a closing could also be achieved by gluing the stabilizing flap 20 to the second side wall 28, once again with an adhesive, for example a permanently plastic hot-setting glue. The stabilizing flap 20 used for stabilization could also be omitted in an alternative exemplary embodiment.

In a first exemplary embodiment, the use of the inner part 32 is omitted. This means that when the blister package 10 is folded open, in addition to the cups, the foil of the blister 36 is now also visible. In a second exemplary embodiment, the inner part 32 is now a component of the blister package 10 and is placed over the cups of the blister 36. The geometry of the inner part cutouts 34 coincides with that of the blister cups. As a result, the foil of the blister 36 is covered over. This inner part 32 is embodied, for example, as a cardboard blank that can optionally be preprinted in a visually attractive way. In this case, in addition to the blister 36, the anchoring flaps 22 also overlap the inner part 32 and are glued to the base region 14 and/or the inner part 32 and/or the blister 36. This securely fastens both the blister 36 and the inner part 32 to the blister package 10 so that they cannot fall out. In a third exemplary embodiment, the inner part 32 is now glued to the blister 36. This further increases the stability of the blister 36. Before the attachment of the inner part 32 to the blister 36, glue or a self-adhesive label can be applied to the blister 36, thus joining the blister 36 to the inner part 32.

The packaging of the blister 36 with the blister package 10 will be described in greater detail in conjunction with FIG. 5. If the blister 36 and the inner part 32 are glued to each other (third exemplary embodiment), then in step A, an adhesive application device 42 applies the adhesive to the blister 36. In particular, this serves to stabilize the blister 36. In the subsequent step B, which is also used in exemplary embodiment no. 2, an inner part insertion device guides the inner part 32 over the cups of the blister 36 and optionally exerts pressure on the inner part 32 in order to glue it to the blister 36. In step C, the blister packages 10 in the form of folding boxes 12 are placed in a storage area. The design of the blister package 10 blank shown in FIG. 1 allows the blister package 10 to be supplied in the form of the folding box 12. The folding box 12 is printed outside of the packing process and is preglued along a longitudinal seam. This pregluing is carried out, for example, by means of an adhesive strip 31 that is fastened to the middle of the closing region 30 and is glued to the base region 14. This adhesive can—as explained above—be used to make the blister package 10 reclosable. When the folding box 12 is flat, the anchoring flaps 22 protrude outward, as does the stabilizing flap 20. Consequently, the shape essentially corresponds to that of a conventional folding box, although the conventional side flaps are missing. As a result, it is now possible to modify the usual conventional cartoning machine only slightly in order to also permit it to be used for reclosable blister packages 10 of the kind shown in FIG. 1. This makes it possible to do away with specialized wallet machines. Existing conventional horizontal cartoning machines can be retrofitted without great expense. Thus in step D, the flat folding box 12 is constructed by a folding box-constructing unit 48. When the folding box 12 is set up, at least one side of the folding box 12 is open so that the blister 36, optionally together with the inner part 32, can be inserted from the side. This is performed by the inserting device 46. After being transported further in travel direction 40, in step E, the adhesive application device 50 applies adhesive to the anchoring flaps 22. The top surfaces of the anchoring flaps 22 here are provided with a strip of adhesive. In a subsequent step F, the two anchoring flaps 22 are brought into the 90° position. In the next step G, a corresponding inserting and pressing unit 52 inserts and presses the fixing flaps 22 into place. In this way, the anchoring flaps 22 are glued to the base region 14 and/or the optionally inserted inner part 32 and/or the blister 36.

In comparison to a conventional horizontal cartoning machine, now the modified cartoning machine is expanded through the addition of the device 50 for applying adhesive to the anchoring flaps 22. In addition, the inserting and pressing unit 52 must be provided, which inserts the anchoring flaps 22 into the interior of the folding box 12 and presses them toward the base region 14 in order to anchor the blister 36 in place.

Figure 6:
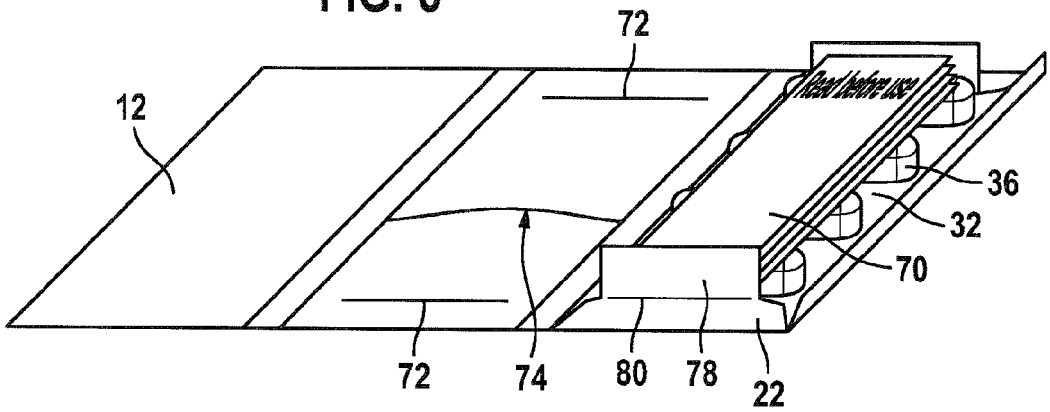
FIG. 6 shows another package that can accommodate an insert when open.
Figure 7:
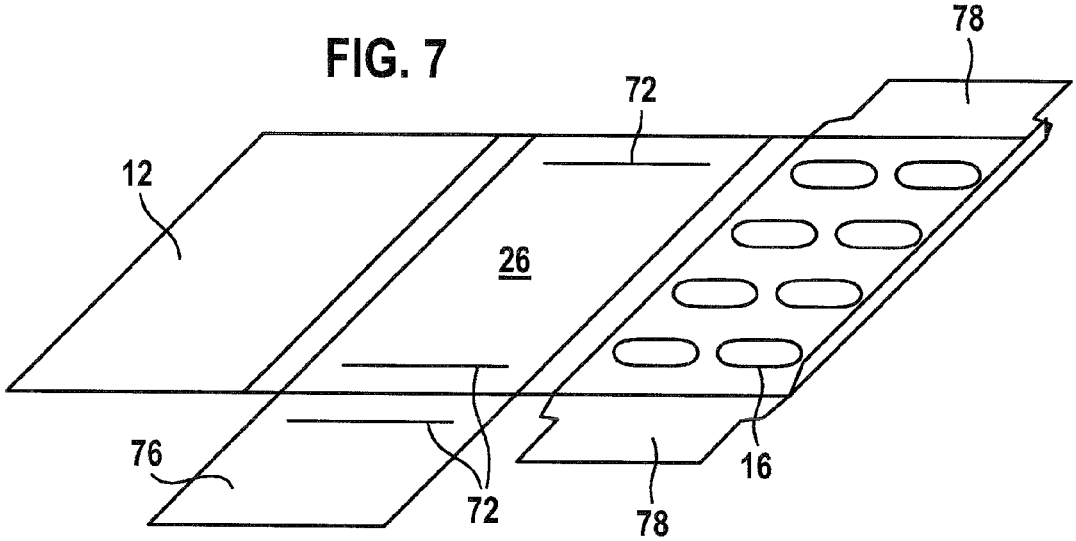
FIG. 7 shows the blank of the folding box associated with the package according to FIG. 6.

Other package versions are also possible without going beyond the basic idea of the above-described package 10. The package shown in FIGS. 6 and 7 is distinguished on the one hand by a receptacle 74 for an insert 70, for example patient information for medications. For this purpose, the end of the bottom region 26 is provided with a relatively long holding flap 76 that is folded into the inside of the bottom region 26 and glued on the left and right sides, perpendicular to the fold line. The receptacle 74 formed when the holding flap 24 is folded inward remains open at the top to permit insertion of the insert 70. On the other hand, this package has the possibility of being closed by means of closing flaps 78 that can be inserted through closing slits 72 provided on the bottom region 26 and the holding flap 76 in order to close the pack. The closing flaps 78 are preferably part of the anchoring flaps 22, but are oriented perpendicularly away from the base region 14 by means of a fold line 80. The part of the flap 22 oriented parallel to the base region 14 can be used, as explained above, to anchor the blister 36 and/or the inner part 32 in place while the perpendicularly oriented flap part 72 serves to close the wallet.

Figure 8:
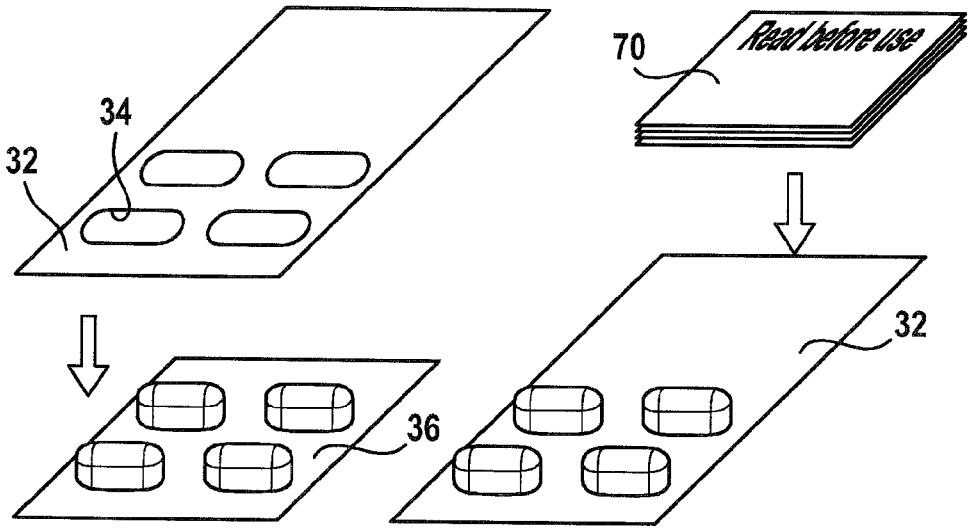
FIG. 8 shows components for another packaging version.
Figure 9:
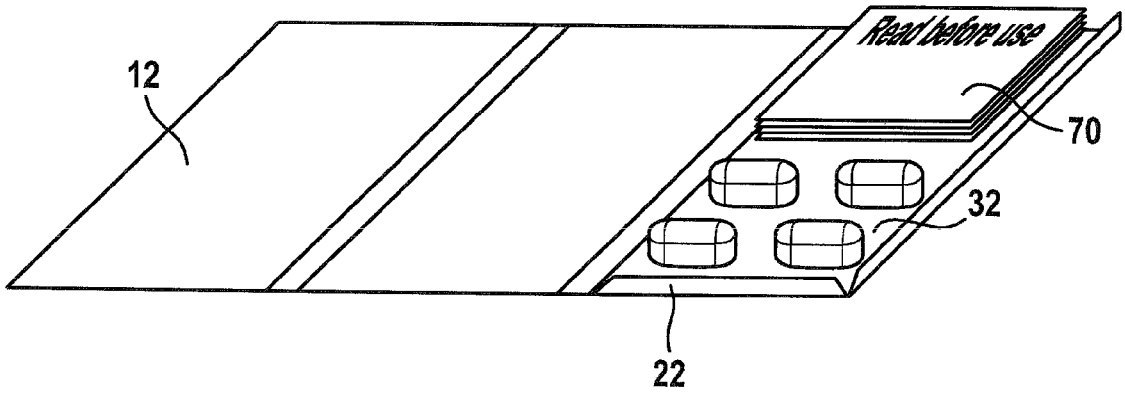
FIG. 9 shows the opened package of the packaging version shown in FIG. 8.

In another package version according to FIGS. 8 and 9, the inner part 32 is embodied so that only its lower region is provided with inner part cutouts 34. The upper region without inner part cutouts 34 can have the insert 70 attached, for example glued, to it. The blister 36 is smaller in size than the inner part 32 and is essentially limited to the region that is also provided with the inner Dart cutouts 34. The insert 70 can be attached to the inner part 32 in the packaging machine.

Figure 10:
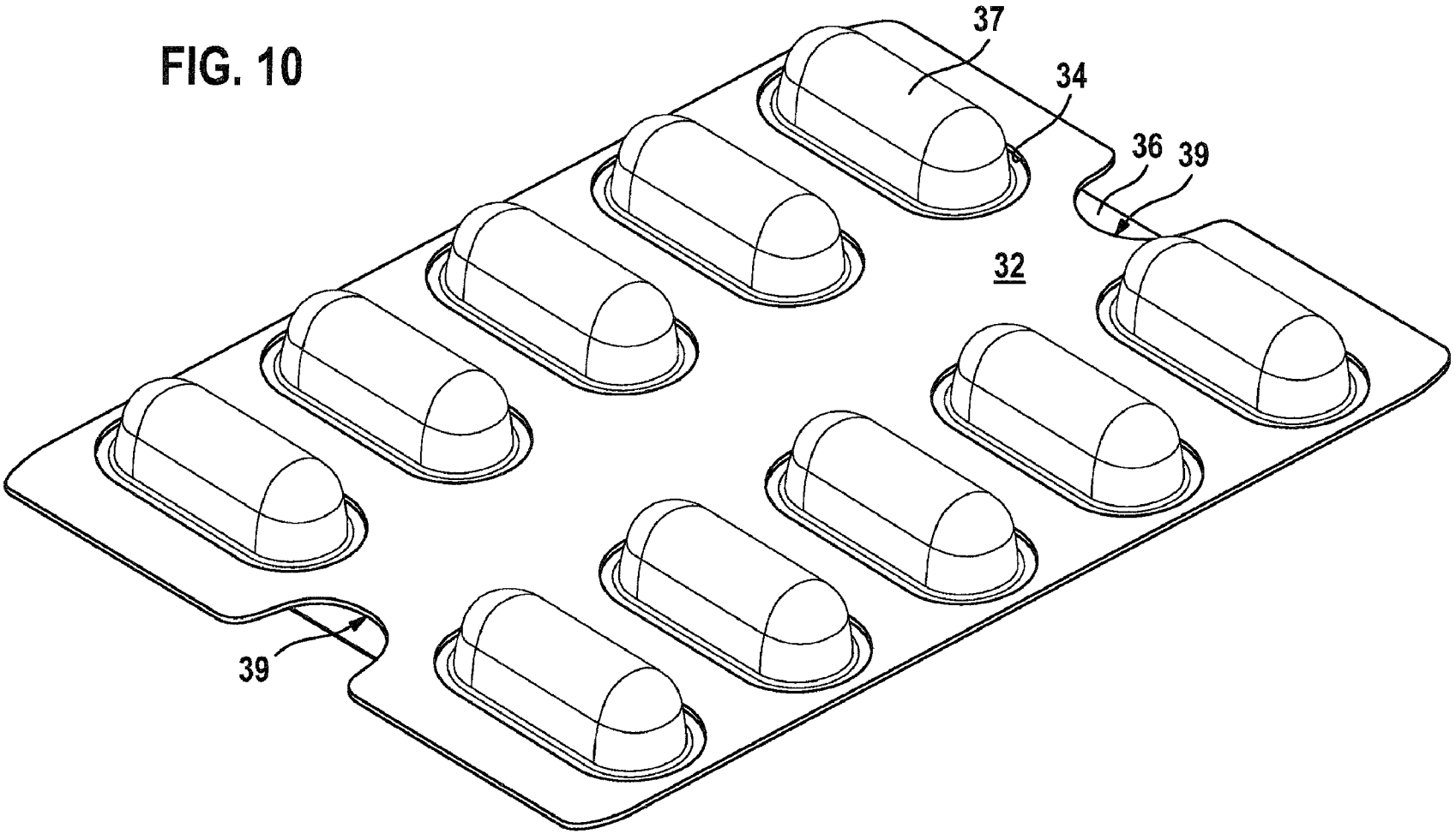
FIG. 10 shows another version of an inner part with a blister.

In another package version, an inner part 32 is shown, which likewise has inner part cutouts 34. As in the exemplary embodiment according to FIG. 2, the geometry of the inner part cutouts is embodied to match the cups 37 of the blister 36 in order to cover over the blister 36 in the manner shown in FIG. 10. Respective recesses 39 are provided at the ends of the inner part 32, preferably in the middle. The recesses 39 are essentially semicircular. These recesses 39 in the inner part are provided to improve the fastening of the inner part 32 and the blister 36. Because the anchoring flaps 22 cover over the recesses 39 after being folded inward, the anchoring flaps 22 can also be glued directly to the base region 14. According to FIG. 10, the dimensions of the recesses 39 have been selected so that the blister 36 is not completely covered in the region of the recesses 39. As a result, in this region of the blister 36 that is not covered by the inner part 32, the anchoring flaps 22 can also be glued to the blister 36. There are a wide variety of conceivable modifications to this version. It is also possible for the inner part 32 to be provided with only one recess 39. This recess 39 can also have different geometric shapes, for example rectangular, triangular, or the like. The size of the recess 39 can also be selected so that the blister 36 is completely covered in the region of the recess 39.

What is claimed is:

1. A method for packaging at least one blister (36) in a blister package (10), the blister package (10) having a base region (14) provided with at least one cutout (16) or perforation (18) for the removal of at least one product contained in the blister (36), the blister package (10) further having a bottom region (26) connected to the base region (14), wherein the blister package (10) includes a closing region (30) connected to the bottom region (26), wherein at least one anchoring flap (22) is provided in the base region (14) in order to anchor at least the blister (36) that is to be packed in the blister package (10), the method having the following steps:

providing the blister package (10), wherein the blister package (10) is folded in the form of a folding box (12);

constructing the folding box (12);

inserting at least one blister (36) from a side;

applying adhesive to at least one anchoring flap (22);

folding the anchoring flap (22); and gluing the anchoring flap (22) to the base region (14) and the at least one blister (36) for anchoring the blister (36) in relation to the base region (14).

2. The method as recited in claim 1, wherein an inner part (32) is placed onto the blister (36).

3. The method as recited in claim 1, wherein adhesive for reciprocal attachment is applied to the blister (36) or to the inner part (32).

4. The method as recited in claim 1, wherein a package insert (70) is inserted into the constructed folding box (12).

* * * * *